US012012563B2

(12) United States Patent
Wijnja et al.

(10) Patent No.: US 12,012,563 B2
(45) Date of Patent: Jun. 18, 2024

(54) CRACKING FURNACE SYSTEM AND METHOD FOR CRACKING HYDROCARBON FEEDSTOCK THEREIN

(71) Applicant: TECHNIP ENERGIES FRANCE SAS, Nanterre (FR)

(72) Inventors: Jelle Gerard Wijnja, The Hague (NL); Peter Oud, Zoetermeer (NL)

(73) Assignee: TECHNIP ENERGIES FRANCE SAS., Nanterre (FR)

( * ) Notice: Subject to any disclaimer, the term of this patent is extended or adjusted under 35 U.S.C. 154(b) by 136 days.

(21) Appl. No.: 17/761,910

(22) PCT Filed: Jun. 19, 2020

(86) PCT No.: PCT/EP2020/067173
§ 371 (c)(1),
(2) Date: Mar. 18, 2022

(87) PCT Pub. No.: WO2021/052642
PCT Pub. Date: Mar. 25, 2021

(65) Prior Publication Data

US 2022/0372377 A1 Nov. 24, 2022

(30) Foreign Application Priority Data

Sep. 20, 2019 (EP) ..... 19198787

(51) Int. Cl.
*C10G 9/18* (2006.01)
*C10G 9/00* (2006.01)
(Continued)

(52) U.S. Cl.
CPC ..... *C10G 9/18* (2013.01); *C10G 9/002* (2013.01); *C10G 9/206* (2013.01); *C10G 9/36* (2013.01)

(58) Field of Classification Search
CPC . C10G 9/002; C10G 9/18; C10G 9/20; C10G 9/206; C10G 9/36
See application file for complete search history.

(56) References Cited

U.S. PATENT DOCUMENTS 4,479,869 A 10/1984 Petterson et al.
2008/0135451 A1* 6/2008 Overwater ..... C10G 9/14 208/125

(Continued)

FOREIGN PATENT DOCUMENTS

EP 0434049 A1 6/1991
EP 1611386 A1 1/2006

(Continued)

OTHER PUBLICATIONS

International Search Report and Written Opinion issued in PCT Application No. PCT/EP2020/067173, dated Aug. 26, 2020.

*Primary Examiner* — Renee Robinson
(74) *Attorney, Agent, or Firm* — Locke Lord LLP; Gabrielle L. Gelozin; Christopher J. Capelli

(57) ABSTRACT

Cracking furnace system for converting a hydrocarbon feedstock into cracked gas comprising a convection section, a radiant section and a cooling section, wherein the convection section includes a plurality of convection banks, including a first high temperature coil, configured to receive and preheat hydrocarbon feedstock, wherein the radiant section includes a firebox comprising at least one radiant coil configured to heat up the feedstock to a temperature allowing a pyrolysis reaction, wherein the cooling section includes at least one transfer line exchanger.

23 Claims, 4 Drawing Sheets

(51) Int. Cl.
*C10G 9/20* (2006.01)
*C10G 9/36* (2006.01)

(56) References Cited

U.S. PATENT DOCUMENTS

| | | | |
|---|---|---|---|
| 2008/0142411 | A1 | 6/2008 | Barendregt et al. |
| 2019/0144759 | A1 | 5/2019 | Oud et al. |

FOREIGN PATENT DOCUMENTS

| | | | |
|---|---|---|---|
| EP | 2004320 | A2 | 12/2008 |
| EP | 2328851 | A2 | 6/2011 |
| WO | 2004/083705 | A1 | 9/2004 |
| WO | 2007/104952 | A1 | 12/2008 |
| WO | 2010/032024 | A2 | 3/2010 |
| WO | WO-2018229267 | A1 | 12/2018 |

* cited by examiner

CRACKING FURNACE SYSTEM AND METHOD FOR CRACKING HYDROCARBON FEEDSTOCK THEREIN

This application is the U.S. National Stage filed under 35 U.S.C. § 371, based on International PCT Application No. PCT/EP2020/067173, filed on Jun. 19, 2020, which claims priority to European Application EP19198787.4 filed on Sep. 20, 2019 in the European Patent Office. The entire contents of these applications are incorporated herein by reference in their entirety.

The invention relates to a cracking furnace system.

A conventional cracking furnace system, as is for example disclosed in document U.S. Pat. No. 4,479,869, generally comprises a convection section, in which hydrocarbon feedstock is preheated and/or partly evaporated and mixed with dilution steam to provide a feedstock-dilution steam mixture. The system also comprises a radiant section, including at least one radiant coil in a firebox, in which the feedstock-dilution steam mixture from the convection section is converted into product and by-product components at high temperature by pyrolysis. The system further comprises a cooling section including at least one quench exchanger, for example a transfer line exchanger, configured to quickly quench the product or cracked gas leaving the radiant section in order to stop pyrolysis side reactions, and to preserve the equilibrium of the reactions in favor of the products. Heat from the transfer line exchanger can be recovered in the form of high pressure steam.

A drawback of the known systems is that a lot of fuel needs to be supplied for the pyrolysis reaction. In order to reduce this fuel consumption, the firebox efficiency, the percentage of the released heat in the firebox that is absorbed by the radiant coil, can be significantly increased. However, the heat recovery scheme in the convection section of a conventional cracking furnace system with increased firebox efficiency has only limited capabilities to heat up the hydrocarbon feedstock to reach the optimum temperature to enter the radiant section. As a result, reducing fuel consumption, and thus reducing $CO_2$ emission, is hardly possible within a conventional cracking furnace system.

In order to at least partly solve this drawback, a low emission cracking furnace system has been developed (WO 2018229267), in which the cooling section includes at least one, preferably two, transfer line exchanger(s) as a heat exchanger. The system is configured such that the feedstock is preheated by the transfer line exchanger before entry into the radiant section. Heating the feedstock in the cooling section, using waste heat of the cracked gas in the transfer line exchanger, instead of heating the feedstock in the convection section, as is generally done, can allow a firebox efficiency to be increased significantly, leading to a fuel gas reduction of up to, or even exceeding, approximately 20%. The firebox efficiency is the ratio between the heat absorbed by the at least one radiant coil for the conversion of the hydrocarbon feedstock to the cracked gas by means of pyrolysis, which is an endothermic reaction, and the heat released by the combustion process in the combustion zone, based on a lower heating value of 25° C. This definition corresponds to the formula for fuel efficiency 3.25 as defined in API Standard 560 (Fired Heaters for General Refinery Service). The higher this efficiency, the lower the fuel consumption, but also the lower the heat that is available for feedstock preheating in the convection section. The preheating of the feedstock in the cooling section can overcome this obstacle. So, in such a cracking furnace system, there is a first feedstock preheating step and a second feedstock preheating step. The first feedstock preheating step includes preheating hydrocarbon feedstock by hot flue gasses of the cracking furnace system, for example in one of the plurality of convection banks in the convection section. The preheating also comprises partial evaporation in case of liquid feedstock and superheating in case of gaseous feedstock. The second feedstock preheating step includes further preheating of the feedstock by waste heat of cracked gas of the cracking furnace system before entry of the feedstock into the radiant section of the cracking furnace system. The second feedstock preheating step is performed using a transfer line exchanger in the cooling section. The transfer line exchanger is typically configured to allow direct heat transfer from the cracked gas to the feedstock. An additional advantage of this cracking furnace system is that fouling by condensation of heavy (asphaltenic) tails is hardly possible in the transfer line exchanger. In the case of gas-to-boiling steam heat transfer, for example when the transfer line exchanger is configured to generate saturated steam as in prior art systems, the boiling water has a heat transfer coefficient that is magnitudes higher than that of the gas. This results in the wall temperature being very close to that of the temperature of the boiling water. The temperature of the boiler water in cracking furnaces is typically around 320° C. and the wall temperature at the cold side of the exchanger is only marginally above this temperature for an extensive part of the cold end of the exchanger, while the dew point of the cracked gas is above 350° C. for most of the liquid feedstock, resulting in condensation of heavy tail components on the tube surface and fouling of the equipment. For this reason, the exchanger needs to be cleaned periodically. This is partly achieved during the decoking of the radiant coil, but at regular intervals the furnace has to be taken out of operation for mechanical cleaning of the transfer line exchanger. This can take several days as it does not only involve hydro-jetting of the exchanger but also controlled slow cooling down and heating up of the furnace to avoid damage. In case of gas-to-gas heat transfer, both heat transfer coefficients are of equal magnitude and the wall temperature of the transfer line exchanger is a lot higher than in the case of gas-to-boiling water heat exchange, the wall temperature being roughly the average value of the two media on each side of the wall. In this system the wall temperature is expected to be around 450° C. on the coldest part and increasing quickly to around 700° C. in the hotter part. This means that the hydrocarbon dew point is exceeded throughout the exchanger at all times and that condensation cannot occur.

However, a disadvantage of this cracking furnace system with an improved efficiency is that there may be a slight increase in product degradation due to a relatively slow cooling down of the effluent, preventing the reaction equilibria to be frozen. Contrary to a conventional transfer line exchanger (TLE) with boiling water on the cold side, the type of transfer line exchanger in this low emission cracking furnace has gas on the cold side. A heat transfer coefficient of gas is considerably lower than a heat transfer coefficient of boiling water, which may restrict heat transfer, as mentioned above. At the same time, an inlet temperature for gas on the cold side of more or less 350° C. and a cold side outlet temperature around 600-650° C. significantly reduces the logarithmic mean temperature difference between the hot effluent to be cooled by the transfer line exchanger and the cooling gas. Due to this relatively low logarithmic mean temperature difference, the freezing of the reaction equilibrium may be relatively slow, and the conversion of products to by-products may increase. As is known to the person skilled in the art, the logarithmic mean temperature difference (LMTD) of a countercurrent flow heat exchanger can be defined as follows: (dTA−dTB)/ln(dTA/dTB) with dTA being the temperature difference at a first end of the heat exchanger, for example here the temperature difference between the hot side inlet temperature and the cold side outlet temperature, and with dTB being the temperature difference at a second end of the heat exchanger, for example here the temperature difference between the hot side outlet temperature and the cold side inlet temperature.

It is an aim of the present invention to solve or alleviate the above-mentioned problem. Particularly, the invention aims at providing an alternative low emission cracking furnace system which can minimize product degradation while maintaining a relatively low need for energy supply, and consequently, a reduced emission of $CO_2$.

To this aim, according to a first aspect of the present invention, there is provided a cracking furnace system for converting a hydrocarbon feedstock into cracked gas comprising a convection section, a radiant section and a cooling section, wherein the convection section includes a plurality of convection banks, including a first high temperature coil, configured to receive and preheat a hydrocarbon feedstock wherein the radiant section includes a firebox comprising at least one radiant coil configured to heat up the feedstock to a temperature allowing a pyrolysis reaction, wherein the cooling section includes at least one transfer line exchanger, wherein the system is configured such that the feedstock is preheated by the transfer line exchanger before entry into the radiant section, wherein the convection section includes a second high temperature coil configured to preheat feedstock after exit of the feedstock from the transfer line exchanger and before entry into the radiant section.

Generally, said first high temperature coil is configured to receive and preheat a hydrocarbon feedstock-diluent mixture, and—accordingly—the convection section of the cracking furnace system is configured for mixing said hydrocarbon feedstock with said diluent to provide said hydrocarbon feedstock-diluent mixture, upstream of the first high temperature coil.

In addition, the present invention relates to a method for cracking hydrocarbon feedstock in a cracking furnace system, e.g. in a cracking furnace system according to the invention, the method comprising mixing the hydrocarbon feedstock with a diluent thereby providing a hydrocarbon feedstock-diluent mixture, and subjecting the hydrocarbon feedstock-diluent mixture to a first feedstock preheating step, a second feedstock preheating step, and a third preheating step before entry of the hydrocarbon feedstock-diluent mixture into a radiant section of the cracking furnace system, in which radiant section the hydrocarbon feedstock is cracked, wherein the first feedstock preheating step includes preheating hydrocarbon feedstock-diluent mixture by hot flue gasses of a cracking furnace system using a first high temperature coil, wherein the second feedstock-diluent mixture preheating step includes further preheating of the feedstock-diluent mixture by waste heat of cracked gas of the cracking furnace system using a transfer line exchanger, wherein the third feedstock-diluent mixture preheating step includes further preheating of the feedstock by hot flue gasses of the cracking furnace system using a second high temperature coil.

In particular, the present invention relates to a cracking furnace system according to any of the claims 1-9, respectively a method for cracking hydrocarbon feedstock according to any of the claims 10-22.

In the art, high temperature coils in convection sections are typically configured to (further) preheat feedstock entering the coil at a temperature that is already above ambient temperature; feedstocks entering the high temperature coil may already have been subjected to an initial preheating step in a feed preheater upstream of the high temperature coil and/or by mixing the feedstock with the diluent (such as steam). As will be discussed in further detail below, in particular high temperature coils are configured to (further) preheat a feedstock(-diluent mixture) having a temperature at the inlet side of the high temperature coil above the water dew point. In particular, when using dilution steam, the water dew point of the dilution steam-hydrocarbon feedstock mixture generally has to be exceeded. Generally, a feedstock(-diluent mixture) temperature at the inlet side of the first high temperature coil of at least about 30° C. above the water dew point is preferred. Typically, said temperature at the inlet side of the first high temperature coil is chosen in the range of 30-70° C. above the water dew point, in particular 35-65° C. above the water dew point; a temperature in the range of 40-60° C. above the water dew point, e.g. about 50° C. above the water dew point, is particularly preferred.

Dependent on the feedstock, the feedstock's hydrocarbon dew point may already be exceeded when entering the first high temperature coil. If not, the feedstock-diluent mixture is typically preheated to a temperature above said hydrocarbon dew point prior to the further preheating step, using waste heat from cracked gas, in the transferline exchanger; typically, the feedstock-diluent mixture (containing part of the total diluent to be added prior to cracking) is then partially evaporated inside the first high temperature coil and mixed with the remainder of the diluent—in particular superheated dilution steam—for the complete evaporation at a diluent (steam) mixing point outside the convection section, such that the feedstock's hydrocarbon dew point is exceeded before entering the second feedstock-diluent preheating step, i.e. before entering the transfer line exchanger. The hydrocarbon dew point needs to be exceeded before the feedstock enters this equipment to prevent severe fouling.

At least part of the diluent is added before or at the entrance of a first feedstock-diluent mixture preheating step, i.e. at or before the first high temperature coil. Thus, the cracking furnace system of the invention comprises a provision to mix diluent and feedstock upstream of the first high temperature coil. If only part of the diluent is added at or before the first feedstock-diluent preheating step (the preheating in the first high temperature coil), the remainder of the diluent is generally added before the second feedstock-diluent preheating step (the preheating in the transferline exchanger using waste heat from the cracked gas). Accordingly, the cracking system according to the invention may comprise a further provision to mix diluent and feedstock downstream of the first high temperature coil yet upstream of the transferline exchanger for transferring waste heat from the cracked gas to the feedstock-diluent mixture.

Further, the following is usually taken into consideration, depending on the feedstock:

For gaseous feedstock (ethane, propane and evaporated LPG) the feedstock generally already enters the convection section above the feedstock's hydrocarbon dew point and simply needs to be at or heated up to a temperature that will ensure that when mixed with all the diluent, in particular dilution steam, the water dew point is exceeded.

For light liquid feedstock such as liquid or partly evaporated LPG and naphtha, the feedstock is generally preheated and partly vaporized in a feed preheater, preceding the first high temperature coil. Final evaporation of the hydrocarbons is achieved when the feedstock is mixed with diluent, in particular superheated dilution steam. Also in this case, the water dew point is exceeded.

For gas condensate and light feedstock with a heavy tail end, the feedstock is generally preheated and partly evaporated in a feed-preheater preceding the first high temperature coil and then mixed with the diluent, in particular superheated dilution steam, such that the water dew point is exceeded. However, the heavy tail is typically only evaporated in the first high temperature coil.

For heavy feedstock, such as gas oil, the feedstock is generally first preheated and then mixed with part of the diluent, in particular superheated dilution steam, to exceed the water dew point before entering the first high temperature coil. In this first high temperature coil, the feedstock is subjected to steam assisted partial evaporation. Final evaporation is typically done by mixing with the remainder of the diluent, in particular superheated dilution steam, prior to entering the second feedstock-steam preheating step. In this case that would be the (primary) transfer line exchanger.

The skilled person will be able to determine the dew points based on common general knowledge.

The radiant section includes a firebox comprising at least one radiant coil configured to heat up the feedstock(-diluent mixture) to a temperature allowing a pyrolysis reaction of the feedstock. The cooling section includes at least one transfer line exchanger as a heat exchanger. The system is configured such that the feedstock(-diluent mixture) is preheated by the transfer line exchanger before entry into the radiant section. The transfer line exchanger for transferring waste heat from the cracked product to the feedstock(-diluent) mixture in a system or method according to the invention is generally configured to allow direct heat transfer from the cracked gas to the feedstock. In an inventive way, the convection section includes a second high temperature coil configured to preheat feedstock(-diluent mixture) after exit of the feedstock from the transfer line exchanger and before entry into the radiant section. Since the final preheating of the feedstock (-diluent mixture) before entry into the radiant section can now be done by the second high temperature coil, the outlet temperature on the cold side of the transfer line exchanger can be kept relatively low, for example around approximately 550° C. instead of more than 600° C., resulting in a higher hot side outlet temperature. As a result, the logarithmic mean temperature difference becomes relatively large, which can accelerate the freezing of the reaction equilibrium and limit the conversion of products to by-products, leading to an improvement of the yield of the system. At the same time, the advantage of a reduced energy supply to the furnace system thanks to the partial preheating of the feedstock(-diluent mixture) in the cooling section by the transfer line exchanger can be maintained.

The second high temperature coil may preferably be located in a bottom part of the convection section. The temperature in the bottom area of the convection section being higher than in the top area of the convection section, and being high enough to be able to provide the necessary duty, this location can provide a relatively high efficiency in the preheating of the feedstock. Moreover, in case the firebox efficiency varies, for example due to temperature fluctuations of the flue gas leaving the radiant section and/or due to fluctuations in the flue gas flow rate, the second high temperature coil may smooth out an effect of these fluctuations on the radiant coil inlet temperature of the feedstock. These flue gas temperature and/or flue gas flow rate fluctuations can for example be due to windy conditions or due to fluctuations in fuel gas composition and/or pressure. A reduction of firebox efficiency due to an increase of the flue gas temperature would raise the second high temperature coil outlet temperature of the feedstock, which is also the radiant coil inlet temperature. In case the radiant coil inlet temperature of the feedstock increases, firing may need to be reduced to maintain a substantially constant radiant coil outlet temperature. This reduction of the firing may again raise firebox efficiency, partly counteracting the reduction of the efficiency. Maintaining an optimized radiant coil inlet temperature is important as a lower inlet temperature of the feedstock(-diluent mixture) would raise the radiant duty and lower the firebox efficiency and raise the fuel consumption, while a higher inlet temperature could result in conversion of feedstock inside the convection section and associated deposition of cokes on the internal surface convection section tubes. This coke deposition cannot be removed during the regular decoking cycle for the removal of cokes in the radiant coil as the tube temperature is too low for combustion of the cokes in the convection section, ultimately requiring a prolonged and costly furnace shut-down for cutting the affected tubes in the convection section and the mechanical removal of the cokes.

In addition, the second high temperature coil offers the advantage of reducing the risk of premature conversion and associated fouling by the formation of cokes and deposits inside stagnant areas of the cold side of the transferline exchanger. This is accomplished, in particular, by lowering the maximum operating temperature inside the transfer line exchanger on the cold side.

By doing the final preheating outside the transferline exchanger in the second high temperature coil, this risk of premature conversion and associated fouling can be avoided, because stagnant areas are absent in the high temperature coil.

Advantageously, the system according to the invention comprises a dilution steam super heater, configured to provide superheated dilution steam. In case at least one of the plurality of convection banks is a high pressure steam superheater or a dilution steam superheater configured to superheat high pressure steam or dilution steam respectively, then the second high temperature coil can preferably be located in a bottom part of the convection section upstream of the at least one steam superheater. As such, the second high temperature coil can protect the steam superheater from overheating.

The convection section is advantageously configured for mixing said hydrocarbon feedstock with a diluent, preferably dilution steam, providing a feedstock-diluent mixture. Accordingly, advantageously the first high temperature heating coil is configured to preheat the feedstock-diluent mixture; the transfer line exchanger is configured to preheat the feedstock-diluent mixture before entry into the radiant section; and the second high temperature coil is configured to preheat the feedstock-diluent mixture after exit of the feedstock-diluent mixture from the transfer line exchanger and before entry into the radiant section. Additionally, the convection section of the cracking furnace according to the invention usually further includes an additional bank in the convection bank, namely a feed preheater configured to preheat the hydrocarbon feedstock upstream of the provision in the cracking furnace configured to mix the preheated feedstock with at least part of the diluent, see also above when discussing different types of feedstock.

Part or all of the diluent is mixed with the hydrocarbon feedstock upstream of the first high temperature coil. If only a part of the diluent is mixed with the feedstock prior to entry into the first high temperature coil, the remainder is usually added prior to the preheating step by the transferline exchanger (using waste heat from the cracked product). The diluent can preferably be steam, in particular superheated steam. Alternatively, methane can be used as diluent instead of steam. The feedstock-diluent mixture is usually superheated in the convection section. This is to ensure that the feedstock-diluent mixture does not contain any droplets anymore. The amount of superheat must be enough to make sure that the dew point is exceeded with sufficient margin to prevent undesired condensation of the diluent (in any of the first high temperature coil, transferline exchanger and second high temperature coil) or feedstock hydrocarbons (in the transfer line exchanger for the second preheating step of the mixture). At the same time, decomposition of the feedstock and coke formation in the convection section, as well as in the transfer line exchanger where the risk of coke formation is still higher due to the higher temperature, can be prevented. Moreover, as the specific heats of both the feedstock-diluent mixture and the cracked gas are very similar, the resulting heat flows are also similar on both sides of the walls of the heat exchanger, i.e. the transfer line exchanger. This means that the heat exchanger can run with practically the same temperature difference of the fluid between the hot side and the cold side throughout the exchanger from one end of the exchanger to the other. This is advantageous both from a process point of view as from a mechanical point of view, even if this temperature difference between the hot side and the cold side may be relatively large. To cope with such a relatively large temperature difference of the fluid between the hot side and the cold side of the (primary) transfer line exchanger, an expansion bellow may be connected to the transfer line exchanger, as is known to the person skilled in the art. Accordingly, a cracking furnace system according the invention or used in a method according to the invention is usually configured for feeding superheated hydrocarbon feed-diluent mixture (typically a mixture of hydrocarbon feed and dilutions steam) to enter the (primary) transfer line exchanger significantly superheated; this to prevent dew point corrosion in said transfer line exchanger.

It is preferred that the cracking furnace system can further comprise a steam drum configured to generate saturated high pressure steam. Boiler water can for example be fed to the steam drum and flow from the steam drum of the cracking furnace system to the at least one transfer line exchanger. After being partly evaporated inside the transfer line exchanger, the mixture of steam and water can be redirected to the steam drum, where steam can be separated from remaining liquid water.

More preferably, the cracking furnace system can further comprise a secondary transfer line exchanger which is located downstream from the primary transfer line exchanger and which is connected to the steam drum, and which is configured to at least partly vaporize boiler water coming from the steam drum, while the primary transfer line exchanger may then be configured to only preheat feedstock. Depending on the firebox efficiency and thus on the available heat in the cooling section, a secondary transfer line exchanger can be placed in series after the main or primary transfer line exchanger to further cool down the cracked gas from the radiant section. While the main transfer line exchanger is configured to preheat the feedstock before entry into the radiant section, the secondary transfer line exchanger can be configured to partly evaporate boiler water. The system can comprise one or more secondary heat exchangers, but the main transfer line exchanger is always configured to preheat feedstock, rather than generate high pressure saturated steam. The secondary transfer line exchanger is preferably configured to provide extra duty, for example by being relatively long. Since the cold side outlet temperature of the feedstock from the primary transfer line exchanger is lower than in a system without a second high temperature which is configured to further preheat the feedstock, the hot side outlet temperature of the effluent from the primary transfer line exchanger is higher than in a prior art system, such that the secondary transfer line exchanger may need to handle more duty and cool the effluent more than in a prior art system to arrive at a similar outlet temperature of the second transfer line exchanger.

The convection section can preferably include at least one high pressure steam superheater configured to superheat high pressure steam coming from the steam drum. Additionally and/or alternatively, boiler water can be fed directly to one of the at least one high pressure steam superheater, which may be configured to generate high pressure steam in the convection section. Since a high pressure steam superheater may possibly overheat, it is preferably protected by another type of convection bank which can transfer heat away from the steam superheater. In a known type of a high efficiency cracking furnace, a boiler coil configured to generate saturated steam was located in a bottom part of the convection section and could protect the high pressure steam superheater while at the same time producing high pressure steam from the heat in the flue gas. However, this may not be an optimal choice from an energy transfer viewpoint since the temperature difference between the boiler water to be heated and the flue gas to be cooled is relatively large. By protecting a high pressure steam superheater from overheating with a second high temperature coil placed upstream of the high pressure steam superheater, as may be the case in the present invention, the energy transfer of the system can be optimized.

The firebox can preferably be configured such that a firebox efficiency is higher than 40%, preferably higher than 45%, more preferably higher than 48%. As mentioned before, the firebox efficiency is the ratio between the heat absorbed by the at least one radiant coil for the conversion of the hydrocarbon feedstock to the cracked gas by means of pyrolysis and the heat released by the combustion process. A normal firebox efficiency of prior art conventional cracking furnaces without feedstock preheating before entry into the radiant section by a transfer line exchanger in the cooling section lies around 40%. If we go above this, the feedstock can no longer be heated up to the optimum temperature as insufficient heat is available in the flue gas: increasing the firebox efficiency from around 40% to approximately 48% would reduce the fraction of the heat available in the convection section from approximately 50-55% to approximately 42-47%. Contrary to such prior art systems, the system according to the present invention can cope with this reduced availability of heat in the convection section. By raising the firebox efficiency with approximately 20% from around 40% to approximately 48%, approximately 20% of fuel can be saved. Firebox efficiency can be raised in different ways, for example by raising the adiabatic flame temperature in the firebox and/or by increasing the heat transfer coefficient of the at least one radiant coil. Raising the firebox efficiency without raising the adiabatic flame temperature has the advantage that the NOx emission does not substantially increase, as might be the case with oxy-fuel combustion or preheated air combustion, which are other ways of raising the firebox efficiency which will be discussed further on. The firebox can for example be configured such that firing is restricted to the hot side of the firebox, i.e. to the area near the bottom of the box in case of a bottom fired furnace, or to the area near the top in case of a top fired furnace. The firebox preferably has a sufficient heat transfer area, more specifically, the heat transfer surface area of the at least one radiant coil is high enough to transfer the heat required to convert feedstock to the required conversion level of the feedstock inside the at least one radiant coil, while cooling down the flue gas to a temperature at the firebox exit, or convection section entrance, that is low enough to obtain a firebox efficiency of higher than 40%, preferably higher than 45%, more preferably higher than 48%. The at least one radiant coil of the firebox preferably includes a highly efficient radiant tube, such as the swirl flow tube, as disclosed in EP1611386, EP2004320 or EP2328851, or the winding annulus radiant tube, as described in UK 1611573.5. More preferably, said at least one radiant coil has an improved radiant coil lay-out, such as a three-lane lay-out, as disclosed in US2008142411.

Regarding the cracking method according to the invention, suitable and preferred conditions/steps can be based on the description above. In a particularly preferred embodiment, the feedstock-diluent mixture is preheated in the first high temperature coil and the feedstock-diluent mixture leaving the first high temperature coil and entering the second feedstock-diluent preheating step (in the transferline exchanger wherein waste heat from the cracked gas is transferred) has a temperature exceeding the feedstock's hydrocarbon dew point.

In a particularly preferred embodiment, the hydrocarbon feedstock-diluent mixture is superheated in the convection section. Herein, the diluent that is most preferably mixed with the feedstock is superheated steam. Essentially all of the diluent may be mixed with the feedstock, prior to the first preheating step of the feedstock-diluent mixture; however it is also possible to mix part of the diluent with the feedstock before the first preheating step and the remainder thereafter, after said first preheating step, further dilution steam is thereafter added to the feedstock-diluent mixture, before subjecting the feedstock-diluent mixture to the further preheating of the feedstock-diluent mixture by waste heat of cracked gas of the cracking furnace system using a transfer line exchanger.

Further, it is in particular preferred that the feedstock is already subjected to a preheating step prior to mixing the feedstock with diluent The present invention will be further elucidated with reference to figures of exemplary embodiments. Therein, FIG. 1 shows a schematic representation of a first preferred embodiment of a cracking furnace system according to the invention;

It is noted that the figures are given by way of schematic representation of embodiments of the invention. Corresponding elements are designated with corresponding reference signs.

Figure 1:
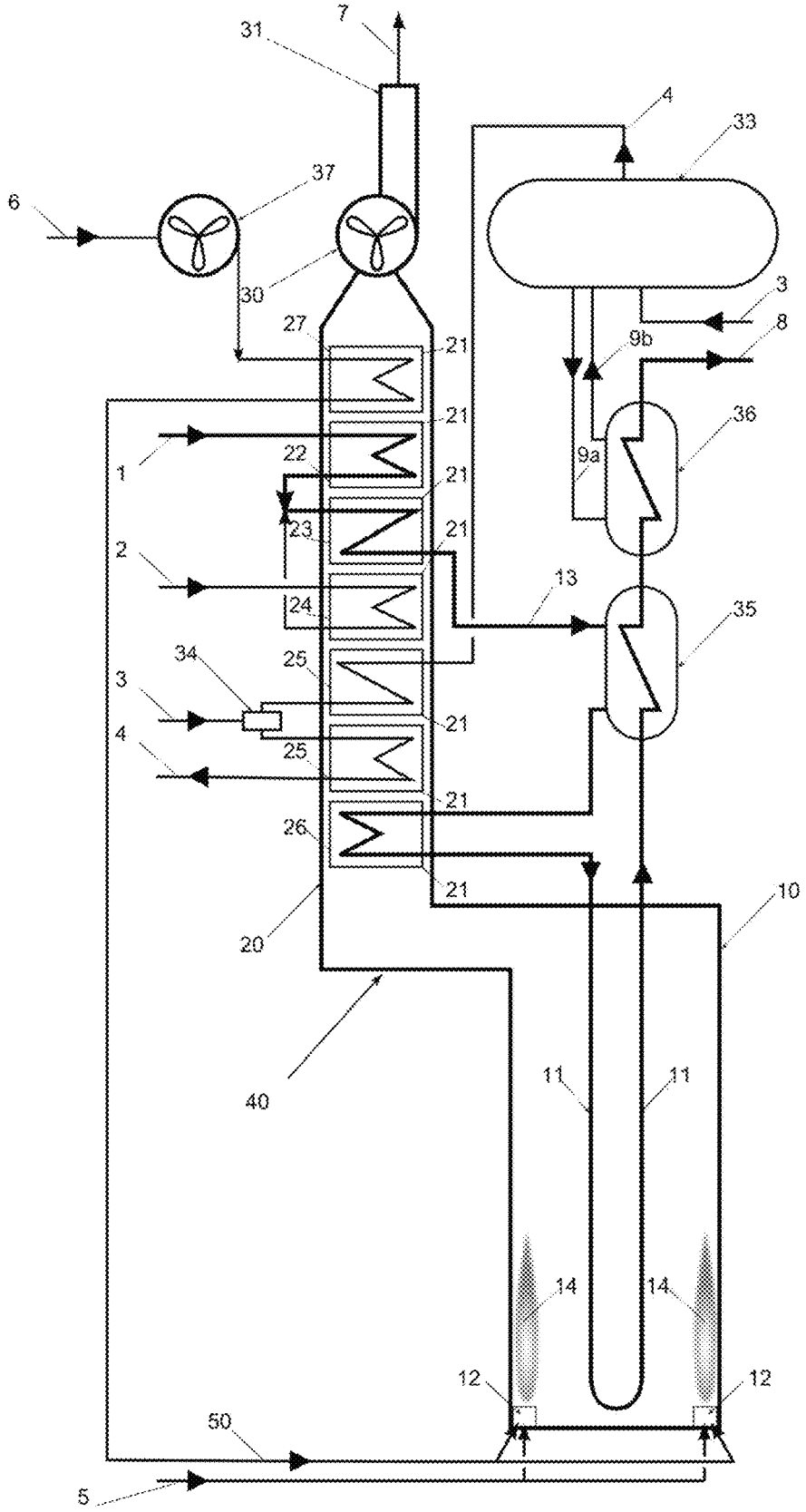

FIG. 1 shows a schematic representation of a cracking furnace system 40 according to a preferred embodiment of the invention. The cracking furnace system 40 comprises a convection section including a plurality of convection banks 21. Hydrocarbon feedstock 1 can enter a feed preheater 22, which can be one of the plurality of convection banks 21 in the convection section 20 of the cracking furnace system 40. This hydrocarbon feedstock 1 can be any kind of hydrocarbon, preferably paraffinic or naphthenic in nature, but small quantities of aromatics and olefins can also be present. Examples of such feedstock are: ethane, propane, butane, natural gasoline, naphtha, kerosene, natural condensate, gas oil, vacuum gas oil, hydro-treated or desulphurized or hydro-desulphurized (vacuum) gas oils or combinations thereof. Depending on the state of the feedstock the feed is preheated and/or partly or fully evaporated in the preheater before being mixed with a diluent, such as dilution steam 2. Dilution steam 2 can be injected directly or, alternatively, as in this preferred embodiment, dilution steam 2 can first be superheated in a dilution steam super heater 24 before being mixed with the feedstock 1. There can be a single steam injection point or multiple steam injection points, for example for heavier feedstock. The mixed feedstock/dilution steam mixture 13 can be further heated in a first high temperature coil 23, and then in the primary transfer line exchanger 35. After exit of the mixed feedstock/dilution steam mixture 13 from the transfer line exchanger 35 and before entry into the radiant section 10, the feedstock or the mixture, is further preheated, according to the invention, by a second high temperature coil 26 in the convection section 20 to reach an optimum temperature for introduction into the radiant coil 11. The radiant coil can for example be of one of the types mentioned before or of any other type maintaining a reasonable run length, as known to the person skilled in the art. In the radiant coil 11 the hydrocarbon feedstock is quickly heated up to the point where the pyrolysis reaction starts so that the hydrocarbon feedstock is converted into products and by-products. Such products are amongst others hydrogen, ethylene, propylene, butadiene, benzene, toluene, styrene and/or xylenes. By-products are amongst others methane, aromatics and fuel oil. The resulting mixture of a diluent such as dilution steam, unconverted feedstock and converted feedstock, which is the reactor effluent called "cracked gas", is cooled quickly in the transfer line exchanger 35, to freeze the equilibrium of the reactions in favor of the products. The waste heat in the cracked gas 8 is first recovered in the transfer line exchanger 35 by heating up the feedstock or feedstock-diluent mixture 13 before it is sent back to the convection section for further preheating in the second high temperature coil 26 before entry into the radiant section 10. Any further excess waste heat in the cracked gas 8 may then further be recovered in at least an additional transfer line exchanger, the secondary transfer line exchanger 36, which is located downstream from the primary transfer line exchanger 35, and which is configured to generate saturated high pressure steam from boiler water 9*a* by at least partly vaporizing boiler water 9*a*. The system can comprise a steam drum 33 configured to generate saturated high pressure steam 4. Boiler feed water 3 may be fed to the steam drum 33. Boiler water 9*a* may then be fed to the secondary transfer line exchanger 36, where it is partly vaporized. The at least partly vaporized boiler water 9*b* may then flow back to the steam drum by natural circulation. In the steam drum 33, the generated saturated steam can then be separated from the boiler water and sent to the convection section 20 to be superheated by at least one high pressure steam superheater 25, for example by a first and a second super heater 25 in the convection section 20. Said at least one super heater 25 can preferably be located upstream of a dilution steam super heater 24, and preferably downstream of the second high temperature coil 26. To control the high pressure steam temperature, additional boiler feed water 3 can be injected into a de-super heater 34 located between a first and a second super heater 25.

The heat of reaction for the highly endothermic pyrolysis reaction can be supplied by the combustion of fuel (gas) 5 in the radiant section 10, also called the furnace firebox, in many different ways, as is known to the person skilled in the art. Combustion air 6 can for example be introduced directly into burners 12 of the furnace firebox, in which burners 12 fuel gas 5 and combustion air 6 is fired to provide heat for the pyrolysis reaction. Alternatively, combustion air 6 may first be preheated in the convection section 20, for example by a convection bank embodied as an air preheater 27 located to a downstream side of the convection section 20, preferably downstream all the other convection section banks in the convection section, as shown. The combustion air 6 may be introduced into the air preheater 27 by for example a forced draft fan 37. Preheating of the combustion air can raise the adiabatic flame temperature and make the firebox more efficient. In the combustion zones 14 in the furnace firebox, fuel 5 and (preheated) combustion air are converted to combustion products such as water and CO2, the so-called flue gas. The waste heat from the flue gas 7 is recovered in the convection section 20 using various types of convection banks 21. Part of the heat is used for the process side, i.e. the preheating and/or evaporation and/or superheating of hydrocarbon feed and/or the feedstock-diluent mixture, and the rest of the heat is used for the non-process side, such as the generation and superheating of high pressure steam, as described above. The combustion in the furnace firebox 10 can be done by means of bottom burners 12 and/or sidewall burners and/or by means of roof burners and/or sidewall burners in a top fired furnace. In the exemplary embodiment of the furnace 10 as shown in FIG. 1, firing is restricted to the lower part of the firebox by using bottom burners 12 only. This can raise firebox efficiency and can drastically reduce fuel gas consumption by up to approximately 20% compared with a conventional scheme. A high firebox efficiency can be achieved among others using for instance only bottom burners (as shown) or a number of rows of side wall burners placed close to the bottom in case of bottom firing, or by using only roof burners or a number of rows of side wall burners placed very close to the roof in case of top firing. Making the firebox taller or placing more efficient radiant coils are other examples to reach this objective. As the heat distribution in this case is rather focused on part of the radiant coil, the local heat flux is increased, reducing run length. To counteract this effect, the application of heat transfer enhancing radiant coil tubes, such as for example swirl flow tube types or winding annulus radiant tube types may be required in the radiant coil in order to maintain a reasonable run length. Other means to gain better performance, such as a three lane coil design, can also be used to increase run length, either separately or in combination with other means. The embodiment in FIG. 1 further shows an induced draft fan 30, also called a flue gas fan, and a stack 31 located at a downstream end of the convection section to evacuate the flue gas from the convection section 20.

With the new inventive arrangement, an optimized radiant coil inlet temperature can be maintained while the logarithmic mean temperature difference in the primary transfer line exchanger can be enlarged, which can accelerate the freezing of the reaction equilibrium and limit the conversion of products to by-products, leading to an improvement of the yield of the system. As an example, the feedstock may enter the transfer line exchanger 35 at a cold side inlet temperature of around 350° C. and be preheated to a cold side outlet temperature of around 555° C. instead of approximately 610° C. previously, whereas at the same time, the effluent may enter the transfer line exchanger 35 with a hot side inlet temperature of approximately 810° C. and be cooled to a hot side outlet temperature of around 630° C. instead of approximately 575° C. in a prior art design. This results in an increase of the logarithmic mean temperature difference from 213° C. to 267° C., which corresponds to an increase of 25% in the logarithmic mean temperature difference in the primary transfer line exchanger, improving the yield of the system with a factor of approximately 0.1% to more or less 2.0%, which may be significant for large production capacities of products such as ethylene, propylene, or butadiene. As mentioned before, maintaining an optimized radiant coil inlet temperature is important as a lower inlet temperature of the feedstock would raise the radiant duty and lower the firebox efficiency and raise the fuel consumption, while a higher inlet temperature could result in conversion of feedstock inside the convection section and associated deposition of cokes on the internal surface convection section tubes.

Figure 2:
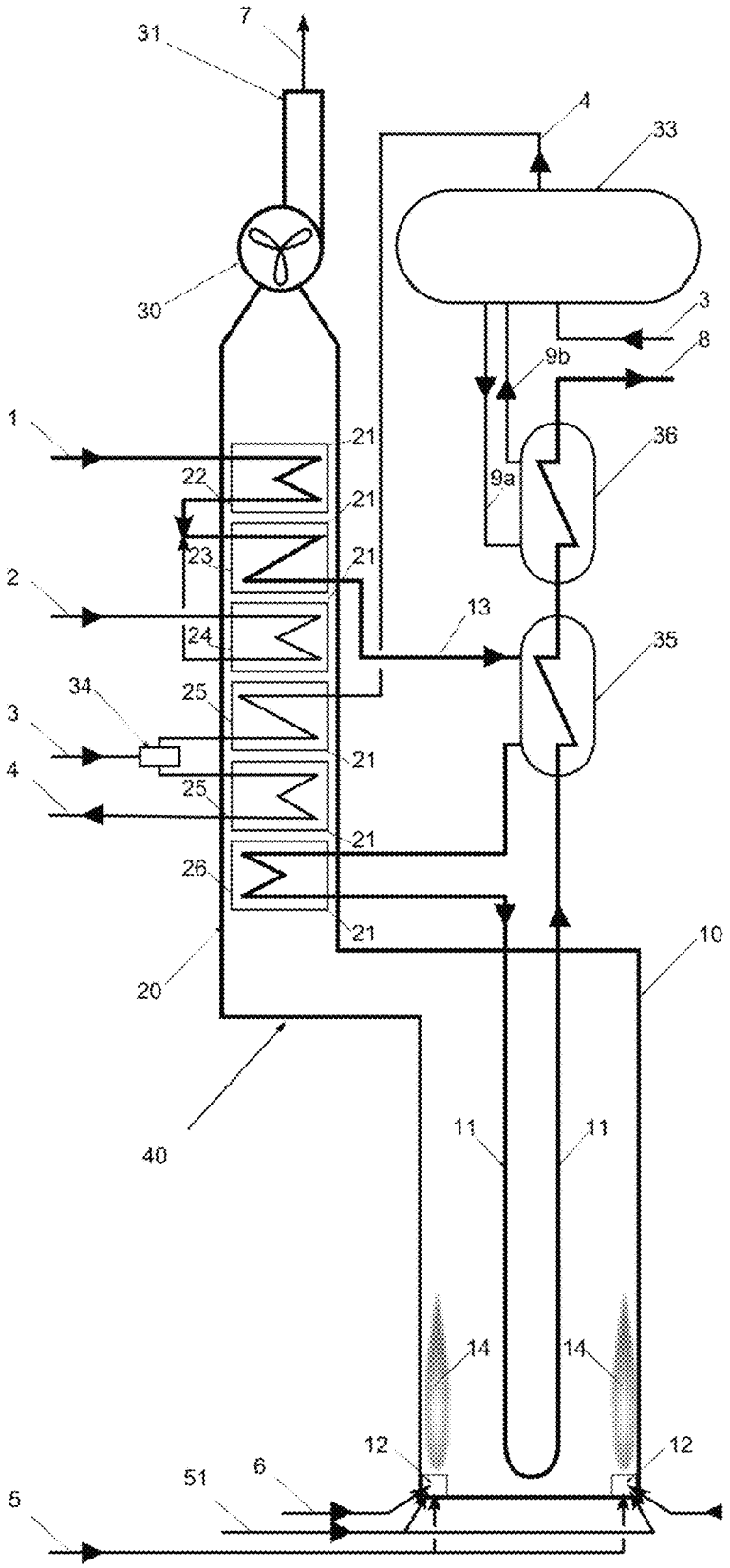
FIG. 2 shows a schematic representation of a second embodiment of a cracking furnace system according to the invention.

The invention of a three-step preheating of hydrocarbon feedstock by a first high temperature coil in the convection section, a transfer line exchanger in the cooling section and by a second high temperature coil in the convection section can also be advantageously applied to alternative cracking furnace systems and methods for cracking hydrocarbon feedstock therein. FIG. 2 shows a schematic representation of a second embodiment of a cracking furnace system according to the invention. In this embodiment, heat for the pyrolysis reaction in the furnace firebox 10 is provided by fuel gas 5, combustion air 6 and highly nitrogen depleted combustion oxygen 51 fired in the burners 12. Introduction of oxygen in the combustion zone 14 can also raise the adiabatic flame temperature as an alternative method to the scheme presented in FIG. 1.

Figure 3:
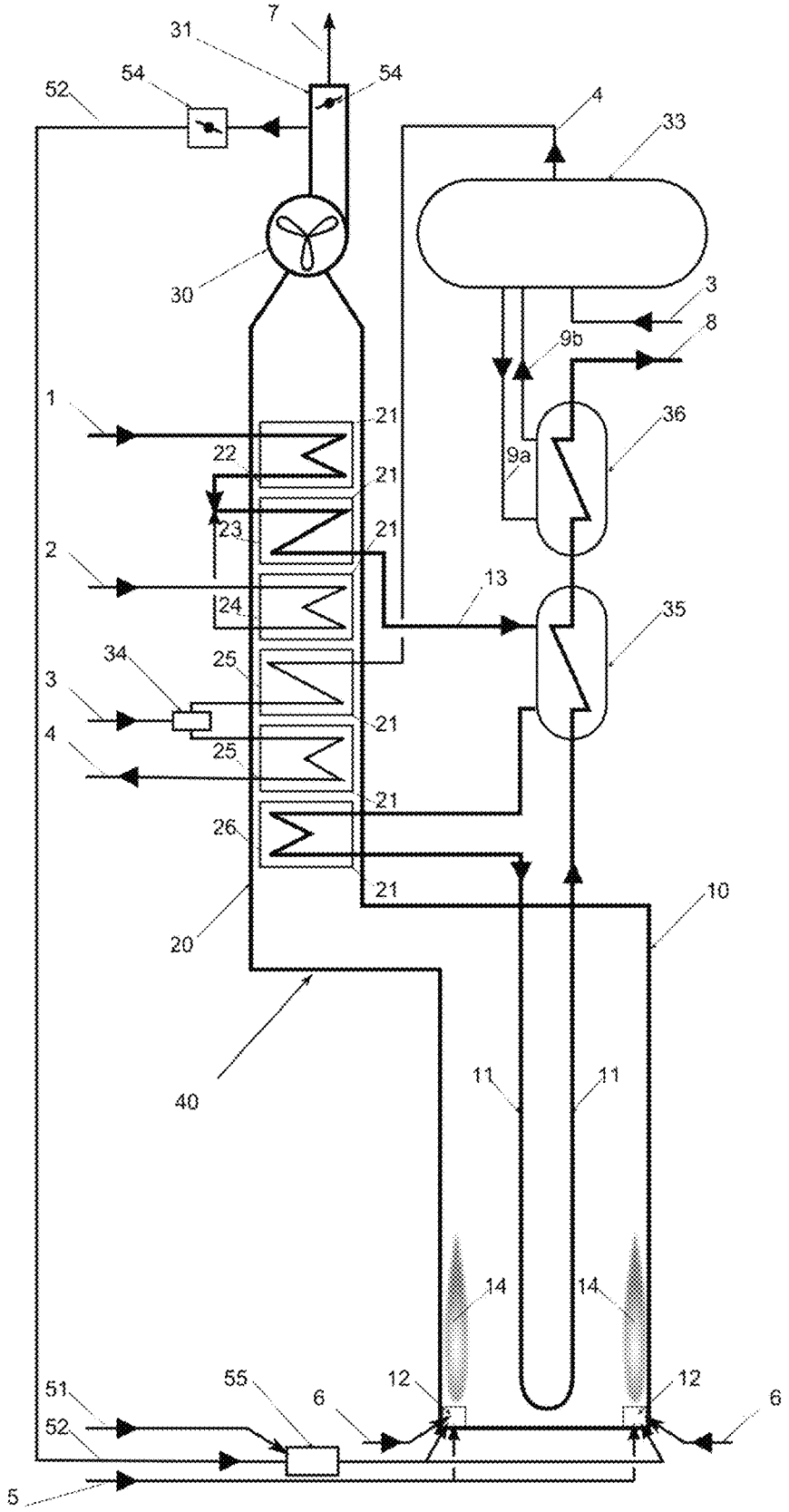
FIG. 3 shows a schematic representation of a third embodiment of a cracking furnace system according to the invention.

FIG. 3 shows a schematic representation of a third embodiment of a cracking furnace system according to the invention. In this embodiment, heat for the pyrolysis reaction in the furnace firebox 10 is provided by fuel (gas) 5, combustion air 6 and highly nitrogen depleted combustion oxygen 51 fired in the burners 12 in the presence of externally recirculating flue gas 52. The combustion oxygen 51 can be mixed with recirculated flue gas 52 upstream of the burners 12 in a common line to the burners 12 using an ejector 55. To obtain the recirculated flue gas 52, the flue gas exiting the convection section 20 can be split by for example a flue gas splitter 54 into produced flue gas 7 and flue gas 52 for external recirculation. The produced flue gas 7 can be evacuated through a stack 31 using an induced draft fan 30. The same fan 30 can be configured to recirculate the flue gas externally to the burners 12. Alternatively, the fan 30 may be embodied as two or more fans, depending on parameters such as pressure drop difference of a downstream system, e.g. stack 31 or flue gas recirculation circuit 52.

Figure 4:
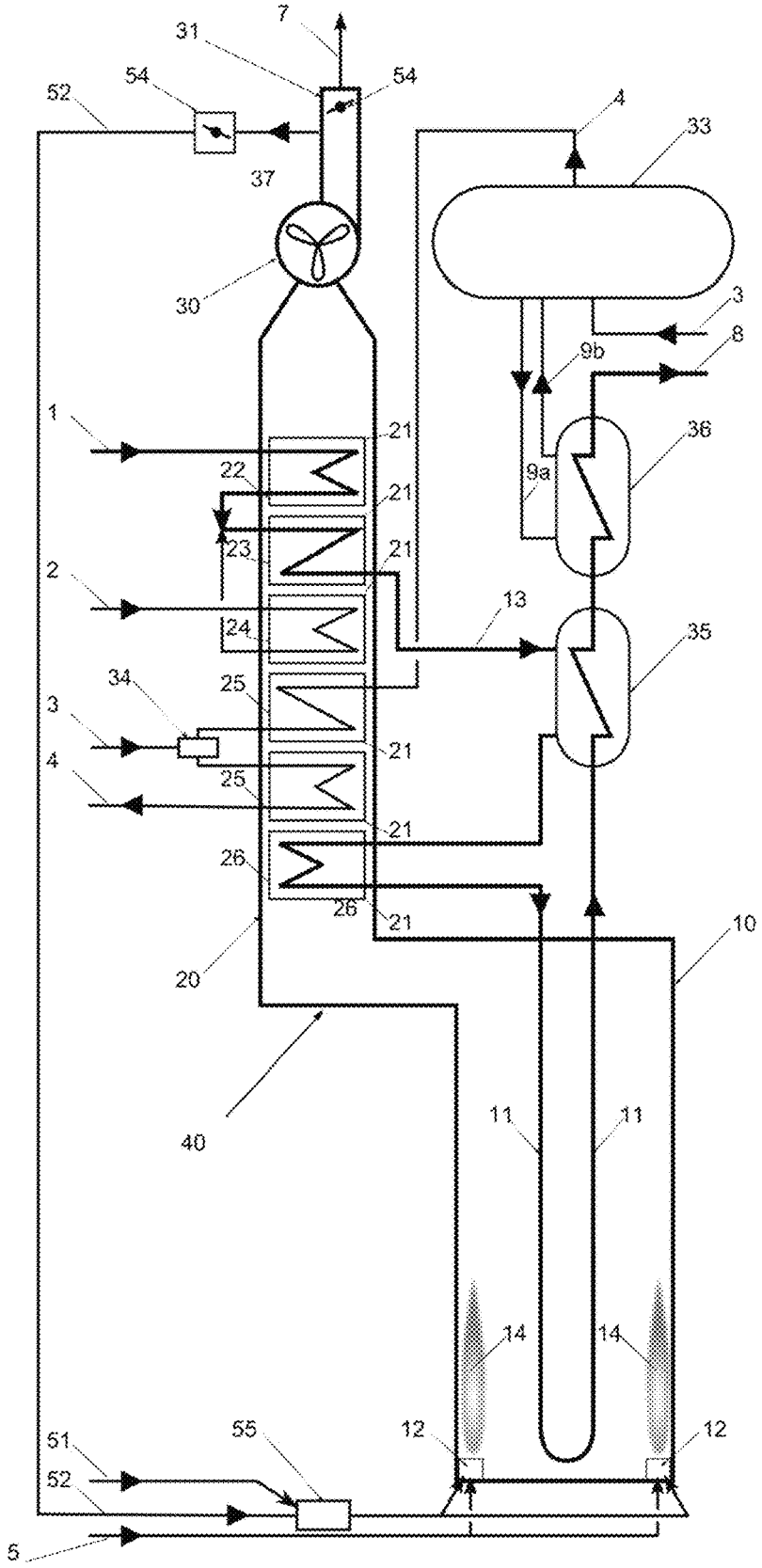
FIG. 4 shows a schematic representation of a fourth embodiment of a cracking furnace system according to the invention.

FIG. 4 shows a schematic representation of a fourth embodiment of a cracking furnace system according to the invention. In this embodiment, heat for the pyrolysis reaction in the furnace firebox 10 is provided by fuel (gas) 5 and highly nitrogen depleted combustion oxygen 51 fired in the burners 12 in the presence of externally recirculating flue gas 52. This scheme is practically the same as the one presented in FIG. 3, except that all the combustion air 6 is replaced by combustion oxygen 51. This is the scheme with the highest consumption of combustion oxygen 51, but the lowest quantity of flue gas leaving the stack. This flue gas is very rich in CO2 making it ideal for carbon capturing, and the NOx emission is the lowest due to the absence of nitrogen, except for the nitrogen associated with air leakage into the convection section. This scheme is the most environmentally friendly.

The work leading to this invention has received funding from the European Union Horizon H2020 Programme (H2020-SPIRE-04-2016) under grant agreement no. 723706.

For the purpose of clarity and a concise description, features are described herein as part of the same or separate embodiments, however, it will be appreciated that the scope of the invention may include embodiments having combinations of all or some of the features described. It may be understood that the embodiments shown have the same or similar components, apart from where they are described as being different.

In the claims, any reference signs placed between parentheses shall not be construed as limiting the claim. The word 'comprising' does not exclude the presence of other features or steps than those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to an advantage. Many variants will be apparent to the person skilled in the art. All variants are understood to be comprised within the scope of the invention defined in the following claims.

REFERENCES

1. Hydrocarbon feedstock
2. Dilution steam
3. Boiler feed water
4. High pressure steam
5. Fuel gas
6. Combustion air
7. Flue gas
8. Cracked gas
9*a*. Boiler water
9*b*. Partly vaporized boiler water
10. Radiant section/furnace firebox
11. Radiant coil
12. Bottom burner
13. Feedstock/dilution steam mixture
14. Combustion zone
20. Convection section
21. Convection bank
22. Feed preheater
23. First high temperature coil
24. Dilution steam super heater
25. High pressure steam super heater
26. Second high temperature coil
27. Air preheater
30. Induced draft fan
31. Stack
33. Steam drum
34. De-super heater
35. Primary transfer line exchanger
36. Secondary transfer line exchanger
37. Forced draft fan
40. Cracking furnace system
50. Preheated combustion air
51. Oxygen
52. Externally recycled flue gas
54. Flue gas splitter
55. Flue gas ejector

The invention claimed is:

1. Cracking furnace system for converting a hydrocarbon feedstock into cracked gas comprising a convection section, a radiant section and a cooling section, wherein the convection section includes a plurality of convection banks, including a first heated coil, operable in use to receive and preheat a hydrocarbon feedstock-diluent mixture, wherein the radiant section includes a firebox comprising at least one radiant coil configured to heat up the feedstock to a temperature allowing a pyrolysis reaction, wherein the cooling section includes at least one transfer line exchanger, characterised in that the system is operable in use to mix a hydrocarbon feedstock with a diluent in the form of a superheated steam to provide said hydrocarbon feedstock-diluent mixture in the convection section, upstream of the first heated coil, wherein the system is operable in use to further preheat the feedstock-diluent mixture after exit from the first heated coil by waste heat of cracked gas of the cracking furnace system in the transfer line exchanger in the transfer line exchanger before entry into the radiant section, wherein the convection section includes a second heated coil operable in use to further preheat the feedstock-diluent mixture after exit of the feedstock from the transfer line exchanger and before entry into the radiant section.

2. Cracking furnace system according to claim 1, wherein the second heated coil is located in a bottom part of the convection section.

3. Cracking furnace system according to claim 1, wherein the cracking furnace system comprises a provision, configured to mix the feedstock with diluent steam, upstream of said first heated coil.

4. Cracking furnace system according to claim 3 wherein the convection section includes at least one dilution steam super heater configured to superheat dilution steam to add to the feedstock or the feedstock-diluent mixture.

5. Cracking furnace system according to claim 3, wherein the cracking furnace system comprises a further provision configured to add additional diluent steam to the hydrocarbon feedstock-diluent steam mixture, which provision is configured to introduce the additional diluent steam into the hydrocarbon feedstock-diluent steam mixture between the outlet for hydrocarbon feed-diluent steam mixture from said first heated coil and the inlet for hydrocarbon feed-diluent steam mixture into said transfer line exchanger.

6. Cracking furnace system according to claim 1, further comprising a steam drum configured to generate saturated heated pressurized steam.

7. Cracking furnace system according to claim 6, further comprising a secondary transfer line exchanger which is located downstream from the at least one transfer line exchanger and which is connected to the steam drum, and which is configured to at least partly vaporize boiler water coming from the steam drum.

8. Cracking furnace system according to claim 6 wherein the convection section includes at least one heated pressure steam superheater configured to superheat heated pressurized steam coming from the steam drum.

9. Cracking furnace system according to claim 1, wherein the plurality of convection banks further includes a feed preheater configured to preheat the hydrocarbon feedstock prior to a provision, configured to mix the preheated feedstock with part or all of the diluent, which provision is situated between said feed preheater and said first heated coil.

10. Cracking furnace system according to claim 1, wherein the plurality of convection banks includes a further provision configured to mix further diluent into the feedstock-diluent mixture which further provision is located downstream of the first heated coil and upstream of the transfer line exchanger.

11. Method for cracking hydrocarbon feedstock in a cracking furnace system, the method comprising mixing a hydrocarbon feedstock with a diluent in the form of a superheated steam to provide a hydrocarbon feedstock-diluent mixture in a convection section of the cracking furnace system upstream of a first heated coil, and subjecting the hydrocarbon feedstock-diluent mixture to a first feedstock preheating step, a second feedstock preheating step, and a third preheating step before entry of the hydrocarbon feedstock-diluent mixture into a radiant section of the cracking furnace system, in which radiant section the hydrocarbon feedstock is cracked, wherein the first feedstock preheating step includes preheating the hydrocarbon feedstock-diluent mixture by hot flue gasses of a cracking furnace system using the first heated coil, wherein the second feedstock-diluent mixture preheating step includes further preheating of the feedstock-diluent mixture by waste heat of cracked gas of the cracking furnace system using a transfer line exchanger after exit from the first heated coil before entry into the radiant section, wherein the third feedstock-diluent mixture preheating step includes further preheating of the feedstock by flue gasses of the cracking furnace system using a second heated temperature coil after exit from the transfer line exchanger and before entry into the radiant section.

12. Method according to claim 11, wherein after said first preheating step, further dilution steam is added to the feedstock-diluent mixture, before subjecting the feedstock-diluent mixture to said further preheating of the feedstock-diluent mixture by waste heat of cracked gas of the cracking furnace system using the transfer line exchanger.

13. Method according to claim 11, wherein heated pressurized steam is generated by waste heat of cracked gas of the cracking furnace system, using a secondary transfer line exchanger located downstream of the transfer line exchanger.

14. Method according to claim 11, wherein the hydrocarbon feedstock-diluent mixture is superheated in a convection section.

15. Method according to claim 11, wherein the feedstock is subjected to preheating prior to mixing the feedstock with diluent.

16. Method according to claim 15, wherein the feedstock is preheated prior to the mixing with the diluent to temperature whereby upon mixing with diluent a feedstock-diluent mixture, to be fed into the first heated coil, is obtained having a temperature exceeding the water dew point.

17. Method according to claim 11, wherein the feedstock-diluent mixture enters the first heated coil at a temperature above the dew point of water.

18. Method according to claim 17, wherein the feedstock-diluent mixture enters the first heated coil at a temperature of 30-70° C. above the dew point of water.

19. Method according to claim 11, wherein the feedstock-diluent mixture is preheated in the first heated coil and the feedstock-diluent mixture already has a temperature exceeding the feedstock's hydrocarbon dew point at the start of the second feedstock-diluent preheating step.

20. Method according to claim 11, wherein the method is carried out in the cracking furnace system, further comprising a steam drum configured to generate saturated heated steam.

21. Method according to claim 20, wherein the cracking furnace system further comprises a secondary transfer line exchanger which is located downstream from the transfer line exchanger and which is connected to the steam drum, and which is configured to at least partly vaporize boiler water coming from the steam drum.

22. Method according to claim 20, wherein the hydrocarbon feedstock-diluent mixture is superheated in a convection section that includes at least one heated pressurized steam superheater configured to superheat heated pressurized steam coming from the steam drum.

23. Method according to claim 11, wherein the hydrocarbon feedstock-diluent mixture is superheated in a convection section that includes at least one dilution steam super heater configured to superheat dilution steam to add to the feedstock or the feedstock-diluent mixture.

* * * * *